US010196590B1

(12) United States Patent
Levy

(10) Patent No.: US 10,196,590 B1
(45) Date of Patent: Feb. 5, 2019

(54) FORMULATION FOR A BIO BASED 99% NATURAL CLEANSER FOR AN AUTOCLAVE UNIT

(71) Applicant: David Levy, Deal, NJ (US)

(72) Inventor: David Levy, Deal, NJ (US)

( * ) Notice: Subject to any disclaimer, the term of this patent is extended or adjusted under 35 U.S.C. 154(b) by 0 days.

(21) Appl. No.: 15/706,012

(22) Filed: Sep. 15, 2017

(51) Int. Cl.
*C11D 3/38* (2006.01)
*C11D 3/382* (2006.01)
*C11D 3/20* (2006.01)

(52) U.S. Cl.
CPC ..... *C11D 3/382* (2013.01); *C11D 3/2082* (2013.01)

(58) Field of Classification Search
CPC ..... C11D 3/48; C11D 3/0015; C11D 3/38; C11D 3/382
USPC ..... 510/152, 159, 481
See application file for complete search history.

(56) References Cited

U.S. PATENT DOCUMENTS

2006/0165622 A1* 7/2006 Hiramoto ..... A61K 8/347 424/65
2007/0065394 A1* 3/2007 Pinney ..... A61K 8/33 424/74
2013/0259822 A1* 10/2013 Dente ..... A61Q 13/00 424/76.1
2016/0100574 A1* 4/2016 Pesaro ..... A01N 31/02 424/48

* cited by examiner

*Primary Examiner* — Gregory E Webb

(57) ABSTRACT

A cleanser for an autoclave unit, comprising natural ingredients, including natural citric acid in powder form of 50 pounds; high purity deionized water having 38 gallons; natural lemon juice having a range of 1 to 1½ gallons; dried cloves having a range of 1 to 3 ounces; dried ground garlic having a range of 1 to 3 ounces; dried peppermint leaves having a range of 1 to 3 ounces; dried thyme leaves having a range of 1 to 3 ounces; dried cinnamon having a range of 1 to 3 ounces; dried pimento leaves having a range of 1 to 3 ounces; and a bio-detergent powder made of natural soap having a range of 5 to 10 gallons added to the deionized water.

1 Claim, No Drawings

FORMULATION FOR A BIO BASED 99% NATURAL CLEANSER FOR AN AUTOCLAVE UNIT

FIELD OF THE INVENTION

The present invention relates to novel a cleaning formulation having a unique combination of natural bio based ingredients to provide a natural and optimum cleanser for autoclave units.

BACKGROUND OF THE INVENTION

Presently existing cleansers do not meet the goal of providing a natural cleanser using natural bio based ingredients, which is a 99% bio based natural cleanser for an autoclave unit. The present invention meets this goal since the natural ingredients provide a unique combination of natural ingredients, and the quantities of the ingredients are also novel.

OBJECTS OF THE INVENTION

It is an object of the present invention to provide a 99% natural bio based cleanser having a unique combination of natural ingredients and a novel combination of quantities of each ingredient, which provide an optimum cleanser using natural ingredients.

SUMMARY OF THE INVENTION

The present invention provides a natural 99% bio based cleanser having the following unique combination of ingredients and quantities for cleaning an autoclave unit. The ingredients are:

- Natural Citric Acid in Powder Form (50 pounds), which is at least 15% by volume.
- High Purity Deionized Water (38 gallons), which is at least 60% by volume.
- Natural Lemon Juice (1 to 1½ gallons added to the Deionized Water), which is at least 1% by volume.
- Dried Cloves (1 to 3 ounces added to the Deionized Water), which is at least 1% by volume.
- Dried Ground Garlic (1 to 3 ounces added to the Deionized Water), which is at least 1% by volume.
- Dried Peppermint Leaves (1 to 3 ounces added to the Deionized Water), which is at least 1% by volume.
- Dried Thyme Leaves (1 to 3 ounces added to the Deionized Water), which is at least 1% by volume.
- Dried Cinnamon (1 to 3 ounces added to the Deionized Water), which is at least 1% by volume.
- Dried Pimento Leaves (1 to 3 ounces added to the Deionized Water), which is at least 1% by volume.
- Bio Detergent Powder made of Natural Soap (5 gallons to 10 gallons added to the Deionized Water), which is at least 10% by volume.

Total—50 gallons

DETAILED DESCRIPTION OF THE PREFERRED EMBODIMENT

The present invention provides the following unique combination of ingredients and quantities for cleaning an autoclave.

Autoclave Cleanser (50 Gallons)

This is an organic and natural liquid cleanser that is 99% bio based for cleaning an autoclave. The ingredients are:

- Natural Citric Acid in Powder Form (50 pounds), which is at least 15% by volume.
- High Purity Deionized Water (38 gallons), which is at least 60% by volume.
- Natural Lemon Juice (1 to 1½ gallons added to the Deionized Water), which is at least 1% by volume.
- Dried Cloves (1 to 3 ounces added to the Deionized Water), which is at least 1% by volume.
- Dried Ground Garlic (1 to 3 ounces added to the Deionized Water), which is at least 1% by volume.
- Dried Peppermint Leaves (1 to 3 ounces added to the Deionized Water), which is at least 1% by volume.
- Dried Thyme Leaves (1 to 3 ounces added to the Deionized Water), which is at least 1% by volume.
- Dried Cinnamon (1 to 3 ounces added to the Deionized Water), which is at least 1% by volume.
- Dried Pimento Leaves (1 to 3 ounces added to the Deionized Water), which is at least 1% by volume.
- Bio Detergent Powder made of Natural Soap (5 gallons to 10 gallons added to the Deionized Water), which is at least 10% by volume.

Total—50 gallons.

ADVANTAGES OF THE PRESENT INVENTION

It is an advantage of the present invention to provide a unique combination of natural bio based ingredients and a unique combination of quantities of each ingredient, which provide an optimum cleanser, using natural ingredients.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A bio based 99% natural cleanser for an autoclave unit, comprising:

(a) natural citric acid in powder form of 50 pounds, which is about 15% by volume;

(b) high purity deionized water having 38 gallons, which is at least 60% by volume;

(c) Natural Lemon Juice (1 to 1½ gallons added to the Deionized Water), which is at least 1% by volume;

(d) Dried Cloves (1 to 3 ounces added to the Deionized Water), which is at least 1% by volume;

(e) Dried Ground Garlic (1 to 3 ounces added to the Deionized Water), which is at least 1% by volume;

(f) Dried Peppermint Leaves (1 to 3 ounces added to the Deionized Water), which is at least 1% by volume;

(g) Dried Thyme Leaves (1 to 3 ounces added to the Deionized Water), which is at least 1% by volume;

(h) Dried Cinnamon (1 to 3 ounces added to the Deionized Water), which is at least 1% by volume;

(i) Dried Pimento Leaves (1 to 3 ounces added to the Deionized Water), which is at least 1% by volume;

(j) Bio Detergent Powder made of Natural Soap (5 gallons to 10 gallons added to the Deionized Water), which is at least 10% by volume.

* * * * *